US006233890B1

(12) United States Patent
Tonyan

(10) Patent No.: US 6,233,890 B1
(45) Date of Patent: May 22, 2001

(54) DRAINABLE SHEATHING MEMBRANE FOR EXTERIOR WALL ASSEMBLY WATER MANAGEMENT SYSTEM

(75) Inventor: Timothy D. Tonyan, Wheaton, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 09/256,928

(22) Filed: Feb. 24, 1999

(51) Int. Cl.[7] ..... E04B 1/70

(52) U.S. Cl. ..... 52/302.3; 52/660; 52/663; 52/302.6; 52/302.1; 52/664

(58) Field of Search ..... 52/302.3, 660, 52/663, 664, 302.6, 302.1

(56) References Cited

U.S. PATENT DOCUMENTS

| | | | | |
|---|---|---|---|---|
| 3,884,009 | * | 5/1975 | Frohlich et al. | 52/302.1 |
| 4,730,953 | * | 3/1988 | Tarko | 52/169.5 |
| 5,826,388 | | 10/1998 | Irving . | |

OTHER PUBLICATIONS

USG Corp. publication *Exterior Systems* three page article titled "Taking the Doubt out of EIFS Wall Performance" by Ted Kellam, 1997.

Fortifiber Corp. eight page brochure and four pages of specifications for moisture vapor barriers; sample specimens of Fortifiber Super Jumbo Tex® barrier and Moistop® flashing, 1998.

Specimen of Tyvek® barrier jointly developed by USG Corp. and Dupont Corp., 1998.

* cited by examiner

*Primary Examiner*—Carl D. Friedman
*Assistant Examiner*—Dennis L. Dorsey
(74) *Attorney, Agent, or Firm*—Lee, Mann, Smith, McWilliams, Sweeney & Ohlson; John M. Lorenzen; David Janci

(57) ABSTRACT

An exterior wall assembly water management system that includes flashing, a drainable weather-resistive membrane, exterior cladding, a basecoat and an exterior finish. The basecoat and the exterior stucco finish are applied to the outer surface of the exterior cladding, or in the alternative to an insulation layer. The disclosed water managed exterior system efficiently directs any penetrating water to weeps, or the like, by providing a water drainage medium between the weather-resistive membrane and the exterior cladding. The water drainage medium is embossed upon the outer surface of the weather-resistive membrane, creating a drainage space between the membrane and the cladding. The unwanted water drains downwards via the drainage space, is caught at the base of the wall by the flashing, and is further drained outside of the wall cladding.

26 Claims, 3 Drawing Sheets

DRAINABLE SHEATHING MEMBRANE FOR EXTERIOR WALL ASSEMBLY WATER MANAGEMENT SYSTEM

BACKGROUND OF THE INVENTION

This invention relates to improvements in exterior finishing systems such as, for example, exterior insulation and finish systems (EIFS) and direct-applied exterior finish systems (DEFS) for buildings. Such EIFS systems are fully described in U.S. Pat. No. 4,647,496. More particularly, this invention relates to an improvement in the management of water as a line of defense by harmlessly handling any unwanted water that has penetrated behind the exterior cladding.

Originally, EIFS was an exterior wall concept designed to have high insulation values and a reliable stucco finish that could be economically created in a wide array of textures and colors. It immediately became successful because it provided so much performance for so little cost. The most unusual aspect of the system was that expanded polystyrene (EPS) insulation was installed on the exterior side of the wall by adhesively bonding it to a substrate, forming a base for an exterior coating as well as adding more insulation to the building. The surface typically has a ⅛-inch-thick synthetic-stucco finish system which performs two functions. It is designed to (1) provide a face-seal or barrier to seal out moisture and (2) provide a decorative finish at the same time. This ⅛-inch-thick finish system consists of reinforcing mesh, latex-fortified basecoat, and an aggregated, polymeric, textured finish.

The principal weaknesses in the prior art EIFS is that they have only one line of defense against water intrusion and no means to drain intruding water. Although the surface usually forms an effective water barrier, intersections of the surface with other elements, such as window frames, door frames, etc., often leave gaps or openings that driving rain can penetrate. Once inside the sealed wall and behind the cladding, the water can remain trapped long enough before evaporating to damage or rot any water-sensitive elements, to which the insulation is bonded including, oriented-strand board, plywood, or gypsum sheathing.

Whether the prior art exterior wall systems provide an insulation layer attached to the exterior cladding which is coated with a stucco-look finish (EIFS), or the stucco-look finish is applied directly over the cladding (DEFS), there has been no provision for water managed relief at the back side of the cladding.

As a result of these problems, a need has arisen for water-managed exterior finishing systems. The present invention discloses an exterior wall system that includes a drainage medium on the outer surface of a weather-resistive membrane. This system provides the designer and building owner with a combination of the optimal properties of a weather-resistive membrane with the long-term reliability of water management.

SUMMARY OF THE INVENTION

The disclosed drainable weather-resistive membrane, when incorporated into a typical exterior finishing system, efficiently manages the drainage of penetrating water by directing the water to weeps or the like. Should water flank the exterior cladding, or enter openings for penetrations, it will be stopped at the weather-resistive membrane, then drained to flashing elements, and removed to the outside through the weeps, thereby protecting the stud cavity and any water sensitive materials in the wall cavity from damage.

In a preferred embodiment, the system utilizes a typical sheathing membrane, as known to one of ordinary skill in the art, that combines both weather resistance with a provision for water drainage. The exterior side of the sheathing membrane is embossed with a drainage medium to form a water managed plane that allows any water that penetrates through the exterior cladding to collect along a textured pattern and drain down the interstitial spaces created by the pattern. In a more preferred embodiment, the drainage medium is a mesh pattern with nodes at the regular intersections of the mesh. When an exterior cladding is applied over the mesh pattern, a drainage space is created between the inner face of the cladding substrate and the sheathing membrane, providing a flow path for the water to drain downwards.

Unlike prior art weather-resistive membranes that include a means for managing water, the disclosed invention provides the weather-resistive membrane with a water vapor permeance in the range of three to forty perms and a water penetration resistance capable of maintaining a minimum hydrostatic head of four inches for a seventy-two hour period. An exterior finishing system that includes this invention can be installed over wood- or steel-stud framing. A structural sheathing may also be included, depending on the design criteria. Flashing components are installed along the bottom edge the system to collect the drained water and direct it away from the system.

BRIEF DESCRIPTION OF THE DRAWINGS

FIG. 6 is a perspective view of the bottom of a cladded wall as in FIG. 1 incorporating the drainable sheathing membrane for exterior wall assembly water-management system showing the managed drainage of water outwardly at lower flashing at weeps there through;

FIG. 8 is a perspective view of the bottom of the cladded wall of FIG. 7 incorporating the drainable sheathing membrane for exterior wall assembly water-management system showing the managed drainage of water outwardly at lower flashing at weeps there through.

DETAILED DESCRIPTION OF THE PREFERRED EMBODIMENT

Figure 5:
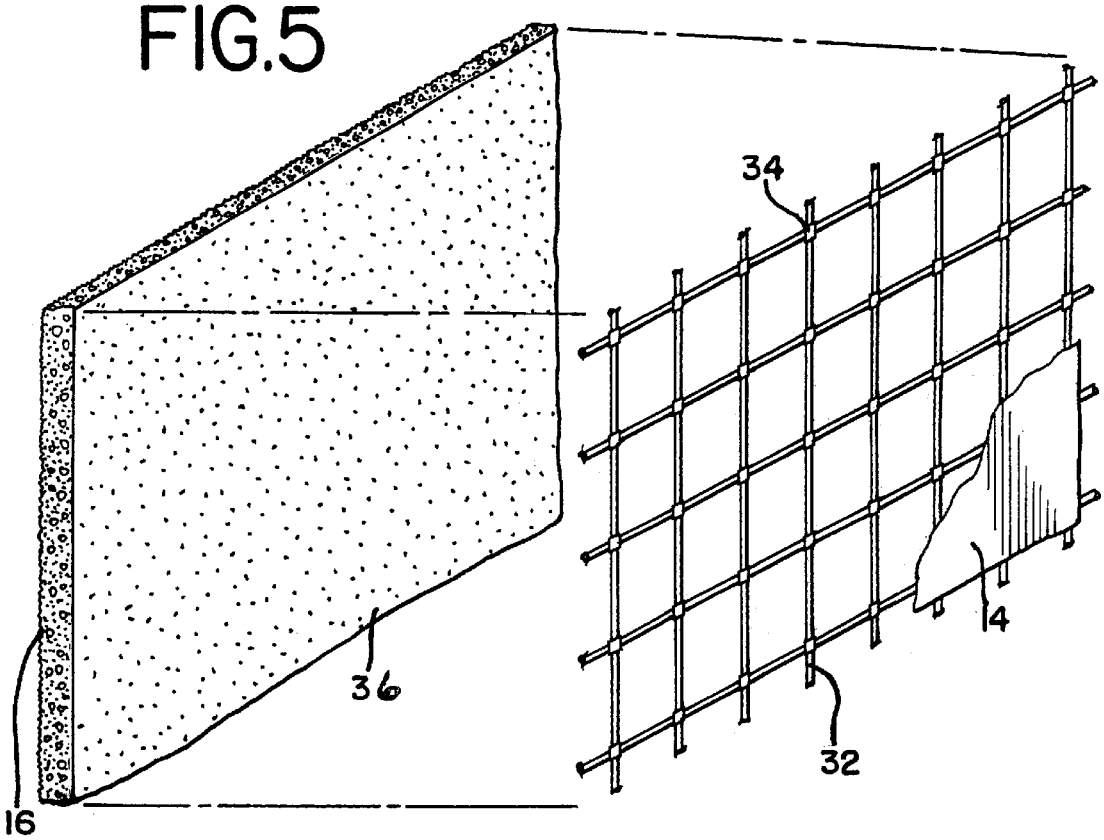
FIG. 5 is an illustration of a method used to create the mesh pattern on the drainable sheathing membrane.
Figure 6:
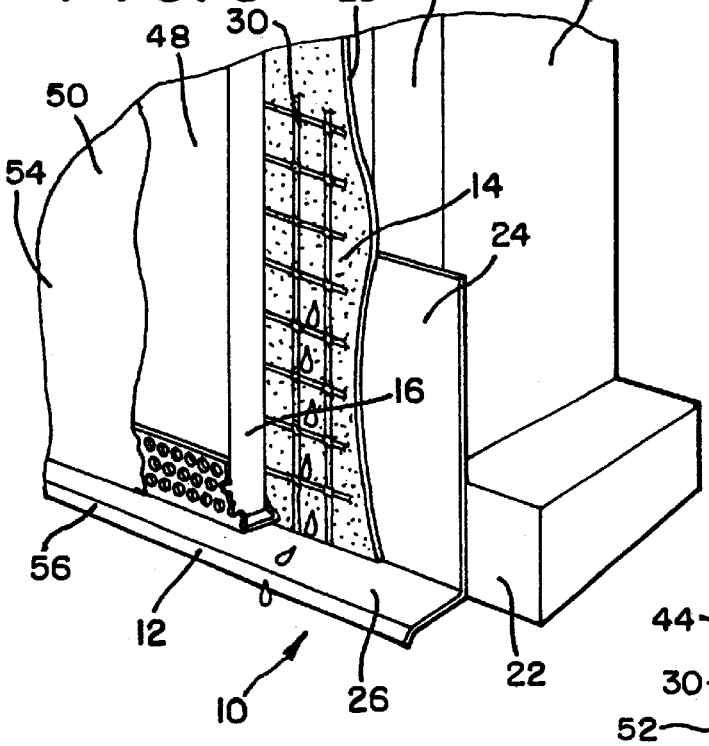
Figure 7:
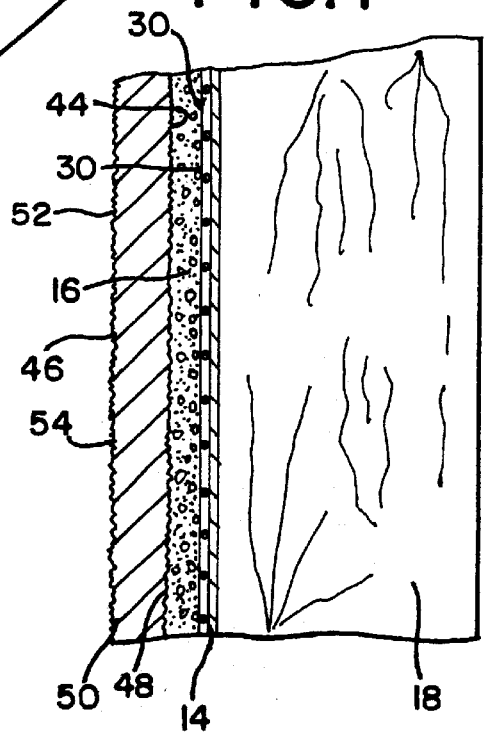
FIG. 7 is a side view similar to FIG. 2 but for an EIFS showing a wall frame member, a drainable sheathing membrane, an exterior cladding, shown as a sheathing panel, and foam insulation adhesively bonded to the exterior cladding.
Figure 8:
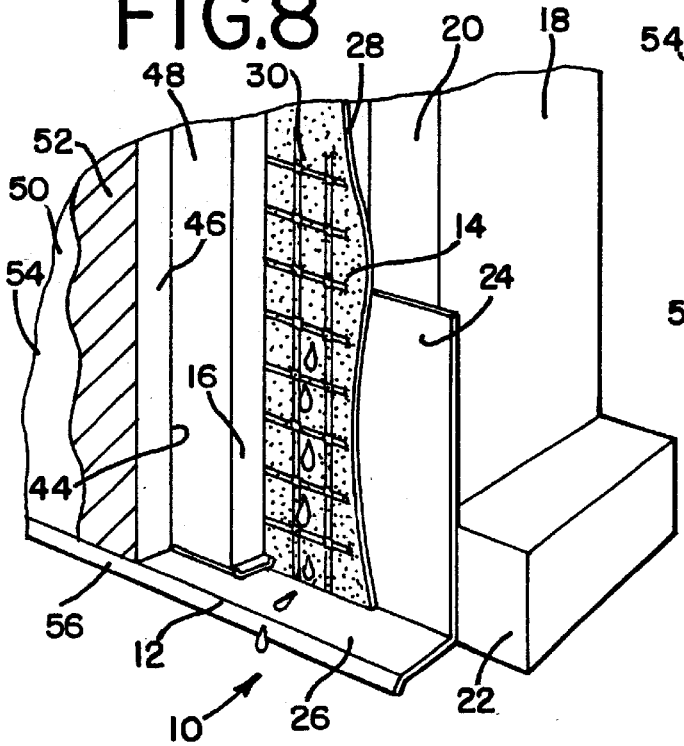

The present invention is directed to exterior finishing systems, as seen in FIGS. 1–8, that are adapted to effectively manage the intrusion of water into the system. As shown in FIGS. 6 and 8, the system, generally designated at reference numeral 10, includes flashing 12, a weather-resistive membrane 14, and an exterior cladding, preferably a sheathing panel 16. The water managed exterior system 10 is designed to be affixed to a plurality of wall framing studs 18 or other support members.

The wall framing studs 18 have an outer surface 20, and are framed on a base shoe member 22. The flashing 12 would typically be a non-corrosive metallic piece that extends only a few inches up from the base shoe member 22 at the lower ends of the wall framing studs 20, and includes a vertically extending flange 24 that is integral with a laterally extending flange 26. The function of the laterally extending flange 26 will hereinafter become apparent. The vertically extending flange 24 is mechanically attached to the base shoe member 22.

The weather-resistive membrane 14 in the disclosed embodiment is standard #15 felt, 60 min. Grade D paper, or equivalent, which has an inner surface 28 and an outer surface 30. The membrane 14 performs several functions. It serves as an air barrier over the building envelope, as well as acting to prevent water penetration as a second line of defense behind the cladding. The inner surface 28 of the membrane 14 is mechanically affixed, usually with staples or adhesive, to the outer surface 20 of the wall framing studs 18, overlapping the flange 24 of the flashing 12. The outer surface 30 of the weather-resistive membrane 14 has a drainage medium 32 embossed upon it. Typically, the drainage medium 32 is a mesh pattern with nodes 34 at the intersection of the mesh at regular intervals. However, it can be appreciated that other textured patterns or unpatterned, irregular relief formations that create interstitial spaces for the unblocked flow of water downwardly would be equivalents.

As illustrated in FIG. 5, the preferred method of embossing the drainage medium 32 to the outer surface 30 of the weather-resistive membrane 14 includes the step of laying the polymer mesh drainage medium 32 on top of the weather-resistive membrane 14, and then coating the medium 32 with a polymer coating that bonds the medium 32 to the membrane 14. A preferred polymer coating is a low density polyethylene coating applied at a thickness of three-fourths millimeter. The mesh 32 and coating are applied to the membrane 14 using a roll coater (not shown). The mesh 32 and membrane 14 are pulled through the roll coater, with the roll coater applying a three-fourths millimeter thick layer of polyethylene over the membrane 14 and mesh 32. As the polymer coating dries, the polyethylene forms a film over both membrane 14 and mesh 32, bonding the mesh 32 to the membrane 14. After the coating completely dries, the coated membrane 14 with embossed mesh 32 is rolled on to a spool (also not shown). Following application of the mesh 32 and coating, the embossed weather-resistive membrane 14 can be perforated or otherwise treated to maintain the water vapor permeance in the range of three to forty perms.

In the preferred embodiment of the invention, the height of the nodes 34 of the drainage mesh 32 is one-eighth inch, although it is known that the height of the nodes 34, or equivalent texturing, can range from about one-thirty-second to about three-sixteenths inch. Further, it is preferred that the nodes 34 be spaced approximately one inch apart, although this spacing can range from no less than one-eighth inch to no more than one and one-half inch apart.

Unlike prior art membranes that include a means for managing water, the disclosed weather-resistive membrane 14 includes a water vapor permeance in the range of three to forty perms (Test standard: ASTM E96, A), and a water penetration resistance of four inches hydrostatic head for a seventy-two hour period. Water penetration resistance is also referred to in the building construction industry as gross water hold out.

Figure 1:
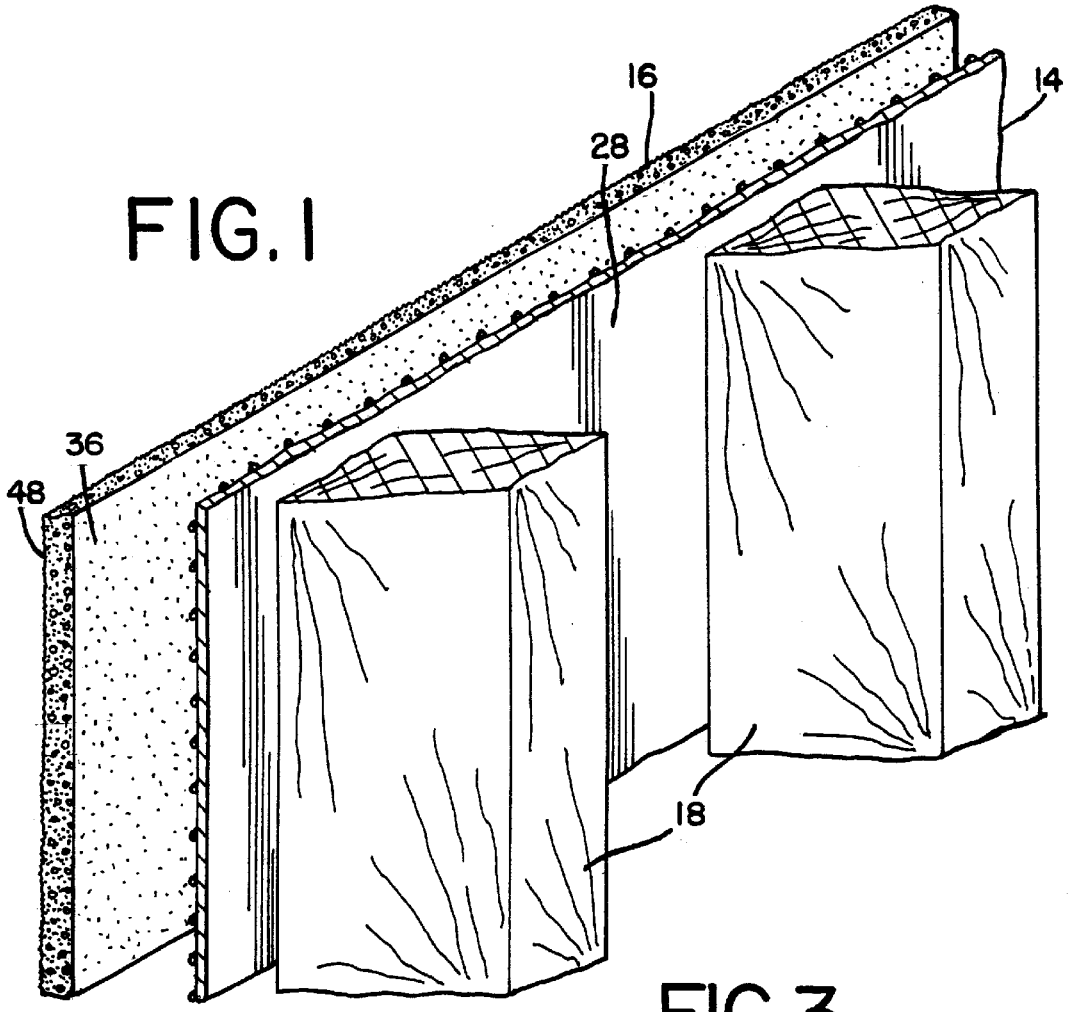
FIG. 1 is a perspective view of the water-management system at an exterior building wall assembly.
Figure 2:
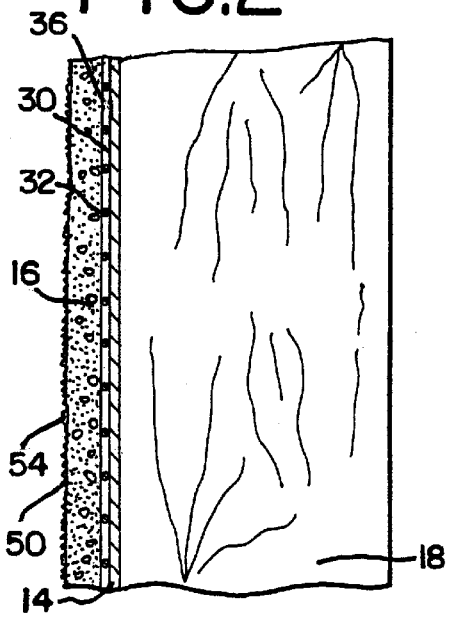
FIG. 2 is a side view of the water-management system of FIG. 1 showing a wall frame member, a drainable sheathing membrane and an exterior sheathing panel thereover.

In FIG. 2, the weather-resistive membrane 14 is mechanically affixed to the wall framing studs 18, with the outer surface 30 of the weather resistive membrane 14 adjacent to the inner surface 36 of the exterior sheathing panel 16. This is usually done through the use of screws (not shown) extending through both the exterior sheathing panel 16 and the weather-resistive membrane 14 into the wall framing studs 18.

Figure 3:
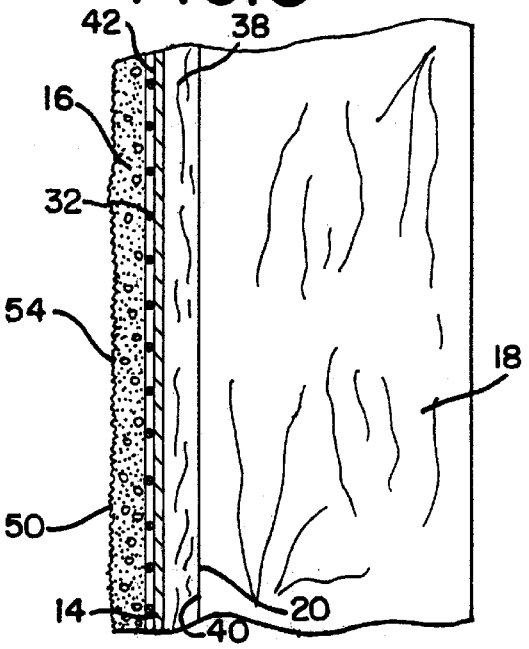
FIG. 3 is a side view of a second embodiment of the water-management system with a structural sheathing attached between wall framing members and the drainable sheathing membrane.
Figure 4:
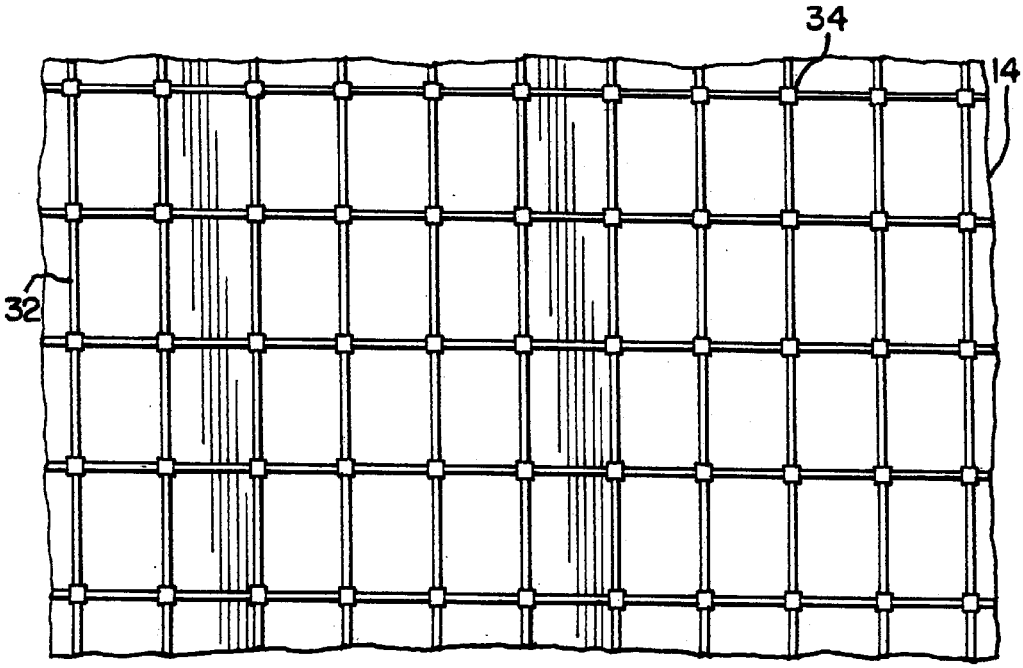
FIG. 4 is an elevational view of the mesh pattern created on the outer surface of the drainable sheathing membrane of FIGS. 2 and 3.

A second embodiment of the invention is illustrated in FIG. 3. An underlayment backer board, or structural sheathing panel 38, having an inner surface 40 and an outer surface 42 is adhered to the wall framing studs 18 by mechanically affixing the inner surface 40 of the sheathing 38 to the outer surfaces 20 of the wall framing studs 18. The flashing 12 (as shown in FIG. 6) and the weather-resistive membrane 14 are then also affixed to the wall framing studs 18 in that order. The structural sheathing 38 is typically plywood, or alternately any other equivalent wood composite board known in the art.

A third embodiment of the invention is for an EIFS is illustrated in FIGS. 7 and 8. The inner surface 44 of an insulation board 46, preferably expanded polystyrene, is preferably adhesively secured onto the outer surface 48 of the exterior sheathing panel 16. Next, a layer of basecoat/adhesive 50 and reinforcing is applied to the outer surface 52 of the insulation board 46 and allowed to dry.

In a fourth embodiment for an EIFS (not illustrated) a structural sheathing panel 38 may also be used wherein the inner surface 40 of the structural sheathing panel 38 is mechanically affixed to the outer surface 20 of the wall framing studs 18, as in FIG. 3. The flashing 12 and the weather-resistive membrane 14 are then also affixed to the wall framing studs 18 in that order. Finally, the inner surface 44 of the insulation board 46 is preferably adhesively secured onto the outer surface 48 of the exterior sheathing panel 16. In both the third and fourth embodiments, a fiberglass mesh reinforced basecoat and textured finish 54 is trowel-applied to the outer surface 52 of the insulation board 46, and floated to the desired look. Securement of the insulation board 46 may be other than by adhesive, such as stapling, nailing or other mechanical and bonding equivalents.

In operation, the outer surface 30 of the weather-resistive membrane 14 with the mesh pattern 32 creates a drainage medium between the inner surface 36 of the exterior sheathing panel 16 and the outer surface 30 of the weather-resistive membrane 14 for managing the water outward of the building structure. This enables water that is present at the interface between the exterior sheathing panel 16 and the weather-resistive membrane 14 to drain freely through the interstitial spaces created by the nodes 34 on the weather-resistive membrane 14. This unwanted water usually comes from leakage around doors or windows, by virtue of the sealant around the doors or windows leaking, from cracks in the decorative and protective exterior finish, or from leaks at the top or parapet of the wall. The drained water is caught adjacent the base shoe member 22 of the wall framing studs 18 by the flashing 12, and is further drained outside the wall by the laterally extending flange 26 of the flashing 12 at weep holes, or the like, at the bottom of the sheathing panel 16. The laterally extending flange 26 is further characterized by a downwardly angled lip 56 that allows the water to drain outward of the building structure.

It will be understood that the texturing of the outer surface 30 of the weather-resistive membrane 14 is provided to create relief on the surface to form a drainage space between the inner surface 36 of the exterior sheathing panel 16 and the outer surface 30 of the weather-resistive membrane 14. It is not limited to the mesh pattern 32. The texturing is preferably formed whereby the weather-resistive membrane 14 may be placed in any orientation onto the wall framing studs 18 or other support members, i.e., lengthwise, sideways or angled, and still provide the flow paths for drainage.

Various features of the invention have been particularly shown and described in connection with the illustrated embodiments of the invention, however, it must be understood that these particular arrangements do not limit but merely illustrate, and that the invention is to be given its fullest interpretation within the terms of the appended claims.

What is claimed is:

1. An exterior finishing system for a building for a system comprising:

a weather resistive membrane having an inner and an outer surface;

an exterior cladding having an inner surface and an outer surface, said inner surface of said exterior cladding disposed adjacent said outer surface of said weather resistive membrane; and means for managing water between said outer surface of said weather resistive membrane and said inner surface of said exterior cladding, said means for managing water including a non-integral separate raised media on said outer surface of said weather resistive membrane, said non-integral separate raised media forming a vertical drainage medium.

2. An exterior finishing system in accordance with claim 1 wherein said non-integral separate raised media includes a plurality of protrusions.

3. An exterior finishing system in accordance with claim 2 wherein said protrusions extend outwardly about 1/32 inch to about 3/16 inch from said raised media.

4. An exterior finishing system in accordance with claim 2 wherein said protrusions are spaced no less than 1/8 inch apart and no more than 1½ inch apart.

5. An exterior finishing system in accordance with claim 1 wherein said means for managing water provides said weather resistive membrane with a water vapor permeance in the range of 3 to 40 perms.

6. An exterior finishing system in accordance with claim 1 wherein said means for managing water provides said weather resistive membrane with a water penetration resistance capable of maintaining a hydrostatic head of 4 inches for a period of 72 hours.

7. An exterior finishing system in accordance with claim 1 wherein said exterior cladding includes a sheathing panel.

8. An exterior finishing system in accordance with claim 1 further comprising a structural sheathing panel attached to said inner surface of said weather resistive membrane.

9. A method of constructing an exterior finishing system comprising the steps of:

attaching a weather resistive membrane with an inner surface and an outer surface to exterior wall framing members of a building;

providing a non-integral raised media drainage structure having an inner surface and an outer surface;

affixing said inner surface of said non-integral raised media drainage structure to the outer surface of said weather resistive membrane;

providing an exterior cladding with an inner surface and an outer surface and attaching said exterior cladding to said framing whereby said inner surface of said exterior cladding overlies said outer surface of said non-integral raised media drainage structure.

10. A method of constructing an exterior finishing system in accordance with claim 9 further comprising the step of providing a structural sheathing panel having an outer surface and disposing said outer surface of said structural sheathing adjacent said inner surface of said weather resistive membrane.

11. A cladded wall comprising:

a plurality of studs having outer surfaces and being framed on a base member;

a flashing component affixed adjacent said base member;

a weather resistive membrane having an inner surface and an outer surface, said inner surface of said weather resistive membrane being affixed to said outer surfaces of said studs;

an exterior cladding having an inner surface and an outer surface, said inner surface of said exterior cladding disposed adjacent said outer surface of said weather resistive membrane;

means for managing water between said outer surface of said weather resistive membrane and said inner surface of said exterior cladding, said means for managing water include a non-integral drainage raised media structure, said non-integral drainage raised media structure including a plurality of protrusions and being disposed at said outer surface of said weather resistive membrane, said non-integral raised media drainage structure forming a vertical drainage medium.

12. A cladded wall in accordance with claim 11 wherein said protrusions extend outwardly about 1/32 inch to about 3/16 inch from said drainage structure.

13. A cladded wall in accordance with claim 11 wherein said protrusions are spaced no less than 1/8 inch apart and no more than 1½ inch apart.

14. A cladded wall in accordance with claim 11 wherein said means for managing water provides said weather resistive membrane with a water vapor permeance in the range of 3 to 40 perms.

15. A cladded wall in accordance with claim 11 wherein said means for managing water provides said weather resistive membrane with a water penetration resistance capable of sustaining a hydrostatic head of 4 inches for a 72 hour period.

16. A cladded wall in accordance with claim 11 wherein said exterior cladding includes a sheathing panel.

17. An exterior finishing system in accordance with claim 11 further comprising a structural sheathing having an inner surface and an outer surface, said inner surface of said structural sheathing attached to said outer surface of said studs and said outer surface of said structural sheathing disposed adjacent said inner surface of said weather resistive membrane.

18. A method of cladding building structures comprising the steps of:

installing a plurality of studs having outer surfaces onto a base member;

installing a flashing component affixed adjacent said base member;

installing a weather resistive membrane having an inner surface and an outer surface, said inner surface positioned at said outer surface of said studs;

installing an exterior cladding having an inner surface and an outer surface, said inner surface of said exterior cladding disposed adjacent said outer surface of said weather resistive membrane;

installing a non-integral raised drainage structure having an outer surface and an inner surface between said weather resistive membrane and said exterior cladding;

forming a vertical drainage medium at said non-integral raised drainage structure thereby creating means for managing water between said outer surface of said weather resistive membrane and said inner surface of said exterior cladding.

19. A method of cladding building structures in accordance with claim 18 wherein said step of installing said non-integral raised drainage structure includes affixing said inner surface of said non-integral raised drainage structure to said outer surface of said weather resistive membrane.

20. A method of cladding building structures in accordance with claim 18 wherein said step of forming a vertical drainage medium includes preforming a plurality of protrusions on said non-integral raised drainage structure.

21. A method of cladding building structures in accordance with claim 18 further including the step of installing a structural sheathing and attaching said structural sheathing to said outer surface of said studs, between said studs and said weather resistive membrane.

22. A drainable sheathing membrane for an exterior finishing system comprising:

a weather resistive membrane having an inner and an outer surface;

a non-integral raised media having an inner and an outer surface, said inner surface of said non-integral raised media disposed on said outer surface of said weather resistive membrane; and said outer surface of said non-integral raised media includes a plurality of protrusions forming a vertical drainage medium.

23. A drainable sheathing membrane in accordance with claim 22 wherein said protrusions extend outwardly about 1/32 inch to about 3/16 inch from said outer surface of said non-integral raised media.

24. A drainable sheathing membrane in accordance with claim 22 wherein said protrusions are spaced no less than 1/8 inch apart and no more than 1½ inch apart.

25. A drainable sheathing membrane in accordance with claim 22 wherein said membrane includes a water vapor permeance in the range of 3 to 40 perms.

26. A drainable sheathing membrane in accordance with claim 22 wherein said membrane includes a water penetration resistance capable of sustaining a hydrostatic head of 4 inches for a 72 hour period.

* * * * *